US006843764B2

(12) United States Patent
Bryant et al.

(10) Patent No.: US 6,843,764 B2
(45) Date of Patent: Jan. 18, 2005

(54) NON-TRAPPED STRIPPER BELT

(75) Inventors: Jason E. Bryant, Newmarket, NH (US); Christopher Alan Cloutier, Barrington, NH (US); Christian Miescher, Bern (CH)

(73) Assignee: Heidelberger Druckmaschinen AG, Heidelberg (DE)

( * ) Notice: Subject to any disclaimer, the term of this patent is extended or adjusted under 35 U.S.C. 154(b) by 3 days.

(21) Appl. No.: 10/092,315

(22) Filed: Mar. 5, 2002

(65) Prior Publication Data

US 2003/0171199 A1 Sep. 11, 2003

(51) Int. Cl.[7] ..... B31F 7/00

(52) U.S. Cl. ..... 493/436; 493/357; 493/428; 493/147; 271/273

(58) Field of Search ..... 493/357, 428, 493/432, 436, 441, 147, 180; 271/273, 275, 198; 198/480.1, 635, 637, 481.1

(56) References Cited

U.S. PATENT DOCUMENTS 3,634,175 A * 1/1972 Delle Vite ..... 156/568
3,667,752 A * 6/1972 Samczyk ..... 271/243
3,973,767 A * 8/1976 Kramer ..... 271/12
4,004,798 A * 1/1977 Akisato ..... 271/286
4,279,410 A * 7/1981 Bolza
4,344,610 A * 8/1982 Jeschke et al. ..... 493/432
4,349,185 A * 9/1982 Small et al. ..... 270/32
4,521,209 A * 6/1985 DuFresne ..... 493/432
4,564,470 A * 1/1986 Schmitt
4,746,107 A * 5/1988 Schneider et al.
5,688,219 A 11/1997 Renard et al. ..... 493/357
6,283,905 B1 9/2001 Singh ..... 493/360

* cited by examiner

*Primary Examiner*—Eugene Kim
*Assistant Examiner*—Sameh H. Tawfik
(74) *Attorney, Agent, or Firm*—Davidson, Davidson & Kappel, LLC

(57) ABSTRACT

A device for transporting a flat product includes a rotating transport cylinder and a continuous stripper belt. The rotating transport cylinder defines an axis of rotation and is configured to guide the flat product at a circumference of the cylinder over a first angle of rotation of the cylinder. The continuous stripper belt is disposed between the flat product and the axis of rotation over a second angle of rotation of the cylinder and is configured to guide the flat product away from the cylinder so as to strip the flat product from the cylinder. The stripper belt follows a continuous path that does not circumscribe the axis of rotation. In addition, a method for transporting a flat product includes guiding the flat product at a circumference of a rotating transport cylinder defining an axis of rotation over a first angle of rotation of the cylinder and stripping the flat product from the transport cylinder using a continuous stripper belt that follows a continuous path not circumscribing the axis of rotation.

18 Claims, 1 Drawing Sheet

NON-TRAPPED STRIPPER BELT

BACKGROUND OF THE INVENTION

1. Field of the Invention

The present invention relates generally to a device for transporting flat products, and particularly to a device for transporting a flat product including a transport cylinder and a stripper belt following a continuous path that passes between the product and an axis of rotation of the transport cylinder and does not circumscribe the axis of rotation.

2. Background Information

In many applications such as printing, copying, and paper handling, it is desired to transport printed paper signatures or other flat products through various devices to accomplish the required processes. Examples of devices that transport such flat products include folders, bindery equipment, printing presses, photocopiers and the like. In some of these devices, a rotating transport cylinder is used to guide the flat product from one location to another. Typically, the transport cylinder grips a flat product in one location, and releases the flat product in a second location. In order to ensure the proper release of the flat product at the desired location, one or more continuous stripper belts may be employed. A stripper roller having an axis of rotation parallel to a rotational axis of the transport cylinder may be disposed adjacent to the transport cylinder in an area downstream of the desired location at which the flat product is to be released from the transport cylinder. Typically, such stripper belts each follow a respective continuous path that circumscribes both the transport cylinder and the stripper roller, so as to pass between the transport cylinder and the flat product being guided by the transport cylinder. Circumferential grooves may be provided in the transport cylinder and/or the stripper roller to help guide keep the stripper along the respective desired continuous paths. U.S. Pat. No. 6,283,905 describes an example of a device including a stripper belt that circumscribes a transport cylinder. (See FIG. 8).

Such devices for transporting flat products are capable of stripping flat products from the transport cylinder accurately and reliably at the desired release location, minimizing instances of incomplete stripping that can lead to jamming of the flat products. Over time, however, these stripper belts are subject to wear and eventual breakage. Because of the continuous path of the stripper belts circumscribe both the transport cylinder and the stripper roller, replacement of worn or broken belts is a time consuming and difficult task.

Pre-spliced continuous stripper belts cannot be used as replacement belts unless the transport cylinder and stripper roller are first disassembled. Instead, the replacement stripper belts, in the form of long strips must first be wrapped around the transport cylinder and roller in the proper position and then spliced to form a continuous belt. The splicing must be performed accurately to provide the proper tensioning of the belt and to minimize unwanted additional thickness of the belt in the area of the splice. Performing the wrapping and splicing operation is time consuming, difficult to perform within the confines of the device, and subject to error, for example, in the form of improper tensioning of the resulting belt, undesired "lump" in the area of the splice, or a weak splice. During the entire time required for performing this difficult splicing operation, the transporting device must cease operation, thus making the operation potentially very costly.

U.S. Pat. No. 5,688,219 describes a device for transporting flat products in the form of a folding apparatus or folder.

Groups of guiding tapes are used to provide positive control of the flat products between a pair of cutting cylinders and a copy guiding cylinder. These guiding tapes are disposed to guide flat products, where the flat products are entrapped between the guiding tapes and the cylinder. One group of guiding tapes follows a continuous path that does not circumscribe the transport cylinder. However, the '219 patent does not describe the use of stripper belts disposed between the flat products and the cylinder.

SUMMARY OF THE INVENTION

The present invention provides a device for transporting a flat product. The device includes a rotating transport cylinder defining an axis of rotation and configured to guide the flat product at a circumference of the cylinder over a first angle of rotation of the cylinder and a continuous stripper belt disposed between the flat product and the axis of rotation over a second angle of rotation of the cylinder and configured to guide the flat product away from the cylinder so as to strip the flat product from the cylinder. The stripper belt follows a continuous path that does not circumscribe the axis of rotation. By following a path that does not circumscribe the axis of rotation of the transport cylinder, according to the present invention, a worn stripper belt may be replaced by another continuous stripper belt, thus improving previous devices in which a non-continuous replacement belt had to first be wrapped around the transport cylinder and then spliced together on the device. According to the present invention, the replacement of worn belts is easier, quicker, and less prone to undesirable results in the splice.

The transport cylinder may include a gripper configured to releaseably grip the flat product during the first angle of rotation. In addition, the second angle of rotation may include the first angle of rotation.

The device may also include a plurality of belt guides configured to guide the stripper belt along the continuous path, and the continuous path may surround at least one half of the circumference of the cylinder. The transport cylinder may define a groove in the circumference and wherein the stripper belt is disposed in the groove over at least part of the continuous path.

The device may also include a stripper roller having a second axis of rotation parallel to the axis of rotation of the transport cylinder and disposed adjacent to the transport cylinder. In addition, the device may also include a second continuous stripper belt disposed between the flat product and the axis of rotation over a third angle of rotation of the cylinder and configured to guide the flat product away from the cylinder so as to strip the flat product from the cylinder, the second stripper belt following a second continuous path that does not circumscribe the axis of rotation. The stripper belt may have a round cross-section.

The present invention also provides a method for transporting a flat product. The method includes guiding the flat product at a circumference of a rotating transport cylinder defining an axis of rotation over a first angle of rotation of the cylinder, and stripping the flat product from the transport cylinder using a continuous stripper belt disposed between the flat product and the axis of rotation over a second angle of rotation of the cylinder. The stripper belt is configured to guide the flat product away from the cylinder so as to strip the flat product from the cylinder. The stripper belt follows a continuous path that does not circumscribe the axis of rotation.

The method may also include gripping the flat product at a first location in the first angle of rotation and releasing the flat product at a second location in the angle of rotation. The second angle of rotation may include the first angle of rotation.

In addition, the method may also include the step of guiding the continuous stripper belt along the continuous path using a plurality of belt guides. The continuous path may surround at least one half of the circumference of the cylinder, and may be disposed in a groove defined in the circumference of the cylinder over at least a portion of the continuous path.

The method may also include the step of guiding the continuous path of the stripper belt from a point away from the circumference of the transport cylinder using a stripper roller having a second axis of rotation parallel to the axis of rotation of the transport cylinder and disposed adjacent to the transport cylinder.

The stripping may be performed using a second continuous stripper belt in conjunction with the continuous stripper belt, the second stripper belt disposed between the flat product and the axis of rotation over a third angle of rotation of the cylinder. The second stripper belt may be configured to guide the flat product away from the cylinder so as to strip the flat product from the cylinder. The second stripper belt follows a second continuous path that does not circumscribe the axis of rotation.

BRIEF DESCRIPTION OF THE DRAWINGS

The present invention is elaborated upon below with reference to the accompanying drawing, in which.

DETAILED DESCRIPTION

Figure 1:
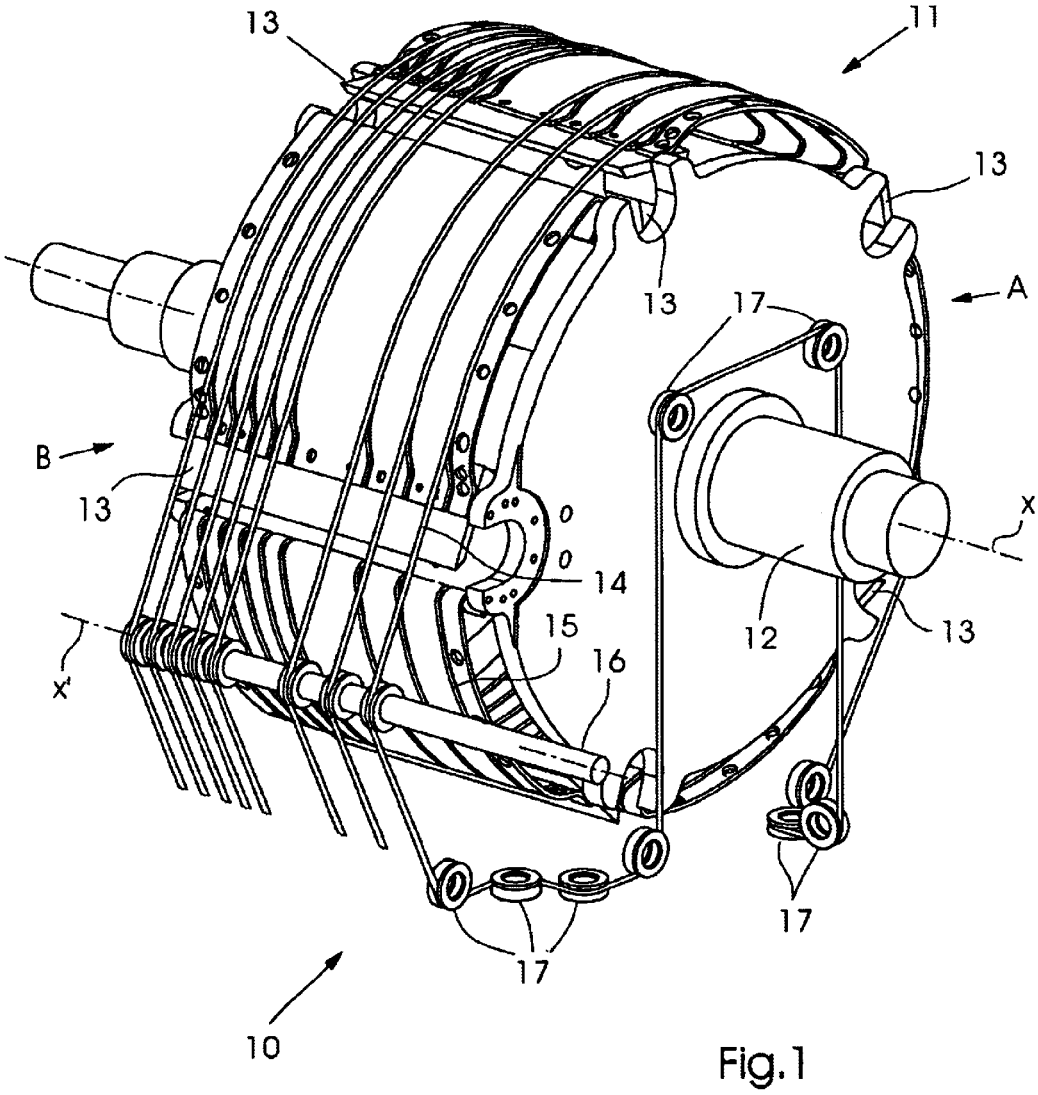
FIG. 1 shows a schematic view of a folder device having a transport cylinder according to the present invention.

Referring to the drawing of FIG. 1, device 10 includes transport cylinder 11 having shaft 12 in a device for transporting flat products, such as inside a folding apparatus of a high speed printing press. Transport cylinder 11 rotates about rotational axis x. Grippers 13, are disposed at the circumference of transport cylinder 11. Grippers 13 are configured to grip a flat product at one location A in the rotation of the cylinder, transport the flat product over an angle of rotation of the cylinder 11, and release the flat product at a second location B in the rotation of the cylinder. In this example, mechanical grippers are shown, however, grippers can grip the flat products using other known techniques, such as, for example, electrostatic forces or suction. Continuous stripper belt 14 is disposed around a portion of the circumference of transport cylinder 11 in groove 15 that are provided for it. During rotation of the transport cylinder 11, (in a counterclockwise direction in FIG. 1), a flat product may be transported by transport cylinder 11 over an angle of rotation of transport cylinder 11 from location A to location B. Over at least that angle of rotation, stripper belt 14 is disposed between the flat product and the transport cylinder 11, or at the very least—where the depth of the groove 15 allow contact between the transport cylinder 11 and the flat product—stripper belt 14 is disposed between the flat product and axis of rotation x).

Stripper roller 16, rotates about axis of rotation x', which is parallel to axis of rotation x of transport cylinder 11, and is disposed adjacent to transport cylinder 11 in the region of location B. Stripper roller 16 guides a continuous path of stripper belt 14 circumferentially away from the cylinder at a region of location B. This relative movement of stripper belt 14 away from transport cylinder 11 causes the flat product to be stripped from gripper 13 of transport cylinder 11 at location B. Once it is stripped, the flat product may be guided, for example, by guiding tapes, grippers, belts or other means, to the next processing device, such as, for example, a collecting cylinder.

The continuous path of stripper belt does not circumscribe the axis of rotation x of transport cylinder 11. Instead, belt guides 17 guide the continuous path of stripper belt 14 from a point downstream of location B back up and around shaft 12 and back into groove 15 at the circumference of transport cylinder 11 at a point upstream from location A. Thus, the direction of travel of the continuous stripper belt while being guided back around the shaft of the cylinder 11, is generally in reverse of the direction of rotation of the cylinder 11. In this embodiment, the belt guides 17 are arranged to guide the continuous path first in an axial direction the side of the rotating cylinder 11, then up and around shaft 12, back down to the circumference of cylinder 11, and finally in axially to groove 15 at the circumference of cylinder 11 at a location upstream from location A. By guiding the belt in an axial direction (i.e. parallel to x) the distance that the belt must travel is reduced, since it does not have to go around a portion of the entire cylinder, but rather only around a portion of the shaft, making the entire continuous path of the belt somewhat shorter than it might otherwise be. Additional stripper belts 18, 19, 20, 21, and 22 (shown partially in FIG. 1) follow continuous paths around transport cylinder 11 similar to that of stripper belt 14. For reasons of clarity, and so not to obstruct the view of the complete continuous path of stripper belt 14, complete continuous paths of stripner belts 18–22 are not shown in their entirety.

In this configuration, the continuous path of the stripper belt 14 does not circumscribe the axis of rotation x of transport cylinder 11, (nor does it circumscribe axis of rotation x' of stripper roller 16). Thus, continuous stripper belt 14 may be replaced in a quicker and easier fashion using a pre-spliced, continuous stripper belt as a replacement belt. The location of one or more of guides 17 can be adjusted to regulate tensioning of the belt or to remove and replace the belt 14. Were the continuous path of stripper belt to circumscribe the axis of rotation x of the transport cylinder, replacement of the belt would require splicing a new belt around transport cylinder 11 on device 10 itself.

What is claimed is:

1. A device for transporting a flat product, the device comprising:

a rotating transport cylinder defining an axis of rotation and configured to guide the flat product at a circumference of the cylinder over a first angle of rotation of the cylinder; and a continuous stripper belt disposed between the flat product and the axis of rotation over a second angle of rotation of the cylinder and configured to guide the flat product away from the cylinder so as to strip the flat product from the cylinder, the stripper belt following a continuous path that does not circumscribe the axis of rotation.

2. The device as recited in claim 1 wherein the transport cylinder includes a gripper configured to releaseably grip the flat product during the first angle of rotation.

3. The device as recited in claim 1 wherein the second angle of rotation includes the first angle of rotation.

4. The device as recited in claim 1 further comprising a plurality of belt guides configured to guide the stripper belt along the continuous path.

5. The device as recited in claim 1 wherein the continuous path surrounds at least one half of the circumference of the cylinder.

6. The device as recited in claim 1 wherein the cylinder defines a groove in the circumference and wherein the stripper belt is disposed in the groove over at least part of the continuous path.

7. The device as recited in claim 1 further comprising a stripper roller having a second axis of rotation parallel to the axis of rotation of the transport cylinder, the stripper roller disposed adjacent to the transport cylinder.

8. The device as recited in claim 1 further comprising a second continuous stripper belt disposed between the flat product and the axis of rotation over a third angle of rotation of the cylinder and configured to guide the flat product away from the cylinder so as to strip the flat product from the cylinder, the second stripper belt following a second continuous path that does not circumscribe the axis of rotation.

9. The device as recited in claim 1 wherein the stripper belt has a round cross-section.

10. A method for transporting a flat product, the method comprising:

guiding the flat product at a circumference of a rotating transport cylinder over a first angle of rotation of the cylinder, the cylinder defining an axis of rotation; and stripping the flat product from the transport cylinder using a continuous stripper belt disposed between the flat product and the axis of rotation over a second angle of rotation of the cylinder, the stripper belt configured to guide the flat product away from the cylinder so as to strip the flat product from the cylinder, the stripper belt following a continuous path that does not circumscribe the axis of rotation.

11. The method as recited in claim 10 further comprising gripping the flat product at a first location in the first angle of rotation and releasing the flat product at a second location in the angle of rotation.

12. The method as recited in claim 10 wherein the second angle of rotation includes the first angle of rotation.

13. The method as recited in claim 10 further comprising guiding the continuous stripper belt along the continuous path using a plurality of belt guides.

14. The method as recited in claim 10 wherein the continuous path surrounds at least one half of the circumference of the cylinder.

15. The method as recited in claim 10 wherein the stripper belt is disposed in a groove defined in the circumference of the cylinder and wherein the stripper belt is disposed in the groove over at least part of the continuous path.

16. The method as recited in claim 10 further comprising guiding the continuous path of the stripper belt from the circumference of the cylinder using a stripper roller having a second axis of rotation parallel to the axis of rotation of the transport cylinder and disposed adjacent to the transport cylinder.

17. The method as recited in claim 10 wherein the stripping is performed using a second continuous stripper belt in conjunction with the continuous stripper belt, the second stripper belt disposed between the flat product and the axis of rotation over a third angle of rotation of the cylinder, the second stripper belt configured to guide the flat product away from the cylinder so as to strip the flat product from the cylinder, the second stripper belt following a second continuous path that does not circumscribe the axis of rotation.

18. The method as recited in claim 10 wherein the stripper belt has a round cross-section.

* * * * *